US008388252B2

(12) United States Patent
Thiebaut

(10) Patent No.: US 8,388,252 B2
(45) Date of Patent: Mar. 5, 2013

(54) DEVICE FOR PACKAGING AND APPLYING A COSMETIC OR CARE PRODUCT

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 665 days.

(21) Appl. No.: 12/197,010

(22) Filed: Aug. 22, 2008

(65) Prior Publication Data

US 2009/0052976 A1 Feb. 26, 2009

Related U.S. Application Data

(60) Provisional application No. 60/969,175, filed on Aug. 31, 2007.

(30) Foreign Application Priority Data

Aug. 22, 2007 (FR) ..... 07 57125

(51) Int. Cl.
*B43K 23/08* (2006.01)

(52) U.S. Cl. ..... 401/213; 401/209

(58) Field of Classification Search ..... 401/208, 401/209, 213, 216, 220, 28, 202, 262, 269; 215/321, 322, 332, 340, 339, 337, 331; 220/300, 220/301, 262, 345.1, 345.2, 351, 345.3
See application file for complete search history.

(56) References Cited

U.S. PATENT DOCUMENTS

| | | | | |
|---|---|---|---|---|
| 3,039,132 | A | 6/1962 | Hambley | |
| 4,811,726 | A | 3/1989 | Goncalves et al. | |
| 4,823,777 | A * | 4/1989 | Goncalves et al. | 401/219 |
| 4,840,511 | A | 6/1989 | Fattori et al. | |
| 4,909,265 | A | 3/1990 | Goncalves | |
| 5,116,156 | A * | 5/1992 | Landi | 401/213 |
| 5,121,850 | A | 6/1992 | Morel | |
| 5,125,757 | A * | 6/1992 | Morrison et al. | 401/214 |
| 6,155,462 | A * | 12/2000 | Brecheisen et al. | 222/153.09 |
| 7,114,871 | B2 | 10/2006 | Thiebaut | |
| 7,618,208 | B2 * | 11/2009 | Baines et al. | 401/213 |
| 8,221,018 | B2 * | 7/2012 | Steinhagen et al. | 401/216 |
| 2004/0005186 | A1 * | 1/2004 | Ueda et al. | 401/209 |
| 2006/0029455 | A1 | 2/2006 | Baines et al. | |
| 2006/0056905 | A1 | 3/2006 | Thiebaut | |
| 2007/0017543 | A1 | 1/2007 | Thiebaut | |
| 2007/0231050 | A1 | 10/2007 | Thiebaut | |

FOREIGN PATENT DOCUMENTS

| | | |
|---|---|---|
| DE | 84 20 113 | 4/1985 |
| EP | 0 411 987 | 2/1991 |
| EP | 1 618 809 | 1/2006 |
| EP | 1 618 811 | 1/2006 |
| FR | 2126067 A3 * | 6/1972 |
| FR | 2 126 067 | 10/1972 |
| FR | 2 601 583 | 1/1988 |

(Continued)

*Primary Examiner* — David Walczak
*Assistant Examiner* — Jennifer C Chiang
(74) *Attorney, Agent, or Firm* — Oblon, Spivak, McClelland, Maier & Neustadt, L.L.P.

(57) ABSTRACT

A device for packaging and applying a cosmetic or care product includes a container intended to contain the product and having at least one product outlet orifice. An applicator member is connected to the container so as to be in communication with the outlet orifice, and a cap is mounted removably on the container between a position covering the applicator member and a removed position. The cap is able to engage with the applicator member in order to close off the outlet orifice. The device includes a guide for guiding the cap in relation to the container, and configured such that the cap is guided in relation to the container along a translation path extending in at least two different directions.

37 Claims, 9 Drawing Sheets

FOREIGN PATENT DOCUMENTS

| | | |
|---|---|---|
| FR | 2 619 689 | 3/1989 |
| FR | 2 650 563 | 2/1991 |
| GB | 843315 | 8/1960 |
| GB | 2 194 152 | 3/1988 |
| GB | 2 371 041 | 7/2002 |

* cited by examiner

DEVICE FOR PACKAGING AND APPLYING A COSMETIC OR CARE PRODUCT

CROSS-REFERENCE TO RELATED APPLICATIONS

This document claims priority to French Application Number 07 57125, filed Aug. 22, 2007 and U.S. Provisional Application No. 60/969,175, filed Aug. 31, 2007, the entire contents of which are hereby incorporated by reference.

BACKGROUND OF THE INVENTION

1. Field of the Invention

The invention relates to the field of bottles for cosmetic or care products and of massage devices comprising such bottles. More particularly, the invention relates to bottles with a product applicator, for example a ball, a roller or a foam. Some of these applicators can be used as massage instruments.

2. Discussion of Background

The term "cosmetic product" is intended to mean a product as defined in Council Directive 93/35/EEC of 14 Jun. 1993.

Bottles with ball- or roller-type applicators are already known in the prior art. Thus, in this field, GB 843 315 describes a ball-type applicator. A device for holding the ball is fixed on the neck of a bottle and comprises openings which are closed off when the ball is pressed in by a screwed-on cap. A drawback of this applicator is that if the cap is unscrewed slightly, there is no longer any sealing engagement. The user is not alerted to this fault, either by sight or by touch. Moreover, the lack of adequate closure of the cap on the bottle necessitates a screw diameter greater than the largest dimension of the applicator. In particular, this type of closure is not suitable for massage apparatuses having a plurality of balls aligned alongside one another.

FR 2 601 583 describes a manual massage device having a plurality of balls. The supply of product to the balls is controlled by a specific central device requiring additional components. Moreover, the sealing device revolves around a circle surrounding all the massage balls. This takes up a lot of space when the massage balls are aligned.

EP 1 618 809 describes a cosmetic fluid dispenser comprising a cap mounted such that it rotates on a container with a massage ball. For this purpose, this cap has three bayonets that screw onto three lugs. Such a screwing movement takes up a lot of space when used in a massage apparatus having a plurality of aligned massage balls.

U.S. Pat. No. 3,039,132 describes a dispensing apparatus equipped with an ellipsoidal applicator stretching along a rotational axis of the applicator. A lid presses on the applicator in order to provide sealing engagement. The lid and the container have an elliptical horizontal section matching the shape of the applicator. They snap together by means of a rim running around the container. Such an apparatus has the drawback that the force required to open and close the lid has to be greater than the pressing force on the applicator in order to provide sealing engagement. Such a lid is hard to open and close. Moreover, there is a risk of the lid coming open due to the fact that the pressing force and opening force of the lid oppose one another.

FR 2 650 563 describes a container stopper having a vertical movement brought about by a stirrup piece secured to the container and having a lateral movement. The bottle stopper carries an applicator roller. The whole assembly is covered by a cap. Such a stopper requires two specific sealing components in addition to the applicator roller and the cap.

SUMMARY OF THE INVENTION

The invention provides a device for packaging and applying a cosmetic or care product which remedies at least one of the above drawbacks.

It is an object of the invention, in particular, to contribute towards the sealing of the device without requiring the use of a specific additional component, and to require a small opening or closing force. Moreover, the closure mechanism, which should take up less space, should be suitable for devices equipped with an elongate applicator or a plurality of aligned applicators.

By way of example, according to one embodiment, the device for packaging and applying a cosmetic or care product comprises a container, intended to contain the product and having at least one product outlet orifice. At least one applicator member is connected to the container so as to be in communication with the outlet orifice, and a cap is mounted on the container removably between a position covering the applicator member and a removed position. The cap is able to engage with the applicator member in order to close off the outlet orifice. In addition, the device comprises a guide arrangement or means for guiding the cap in relation to the container and configured such that the cap is guided or slides in relation to the container along a translation path extending in at least two different directions.

According to an example, the guide or guide means are configured such that the cap is guided in relation to the container only or exclusively along the translation path. In other words, the cap is not rotated about an axis coincident with or parallel to the axis of a dispensing orifice of the container. The cap is not driven by a combined translational and rotational movement about the axis of the dispensing orifice, such as a screwing operation.

The term "translation" should be understood as meaning a movement along a rectilinear or linear path. For example, the translation path may be a path having two different angles of slope. These paths in this case may define an angle of between 110 and 160°, more preferably of between 120 and 150° and even more preferably of between 130 and 145°.

In such a device, the closure movement of the cap may help to close off the orifice by moving in at least one direction of translation which is angled with respect to a closing-off or pressing direction, which can allow the force for closing or opening the cap to be smaller than the force allowing sealing engagement. All that is required is a simple change of direction of the force; there is no need for additional components. Moreover, in contrast to a screwing solution, a circular form is not required for the guide means and the cap. This makes it possible to close off a plurality of aligned orifices without the device taking up too much space.

According to a variant or alternate feature, the guide or guide means is able to guide the cap in relation to the container along a closure path, with a final section of the closure path extending at least partially transversely to the closing-off direction of the orifice.

The closing-off direction of the orifice is to be understood as the normal to the plane containing overall the edge on which the orifice is intended to be closed off. In other words, it is the direction in which the orifice opens, the general direction of the orifice.

According to a preferred example, the fact that the cap closes transversely to the closing-off direction of the orifice makes it possible to transform a cap-closing force into a force for closing off the orifice. This makes it possible for example to seal the device without a large closure force being required.

Advantageously, according to an example, the cap has at least one substantially rigid part, and the means for guiding the cap are arranged such that, in a final section of the closure path, the points of the rigid part of the cap move parallel to one another.

The expression "substantially rigid parts of the cap" is to be understood as meaning the parts that move as a unit when the cap is closed manually in a normal manner. This excludes any resilient parts of the cap that are able to deform locally in order to contribute for example towards locking the cap.

According to an example, in the final section of closure, the cap moves parallel to itself. In other words, at least the final part of the closure is a translation or a succession of elementary translations of the cap, i.e. a translation along a closure path which can be rectilinear or curvilinear. This does not force the cap to rotate about an axis. This has the advantage, in contrast to conventional screwing, that the form of the cap can be adapted to the form of the bottle. This is particularly useful for caps provided on top of containers having an elongate horizontal section, for example for devices having a plurality of aligned cosmetic applicators.

The final translational movement of such a cap takes place in one or a plurality of successive directions transverse to the relative movement between a closing-off element and an orifice of the container.

According to a variant, the device comprises a lock or locking means holding the cap in a closed position.

Advantageously, by way of example, the lock or locking means comprises at least one fixed bead able to engage with a protrusion that can move resiliently in a direction perpendicular to the final section of the closure path.

According to a variant or alternate example, the guide or guide means comprise at least one protrusion provided on the cap and able to engage with a corresponding guide track formed on the container or vice versa.

Advantageously, according to an example, the guide track has a groove comprising two opposite side walls connected by a web.

Also advantageously, according to an example, the guide track can include an insertion area for the protrusion, in which area the side walls converge towards one another.

Advantageously, by way of example, the guide track has a first section for conveying a part of the cap to the level of the applicator member and a second section for conveying the part into abutment against the applicator member so as to close off the outlet orifice.

Advantageously, for example, the guide track has a first section and a second section that define between themselves an angle of between 100° and 160°.

Advantageously, the guide track extends along a vertical flank of the container, for example.

According to a variant or alternate example, the guide means extend on either side of the applicator member.

For example, the guide means can advantageously comprise at least two guide tracks, each formed in a plane vertical flank of the container, with the opposite vertical flanks extending on either side of the applicator member and being approximately parallel to one another.

According to a variant or alternate example, the applicator member comprises at least one surface that can be supplied permanently with cosmetic product.

Advantageously, according to an example, the applicator member comprises an applicator element having the form of a sphere, a cylinder, a barrel or an ellipsoid.

According to one example of an embodiment, the applicator member comprises an applicator element free to move in rotation and/or translation inside a holding device. The rotational movement allows a quantity of cosmetic or care product adhering to the surface of the applicator element to be transferred from the outlet orifice to the projecting part in order at least partly to be deposited on the user's body. The rotational movement allows it to be rolled over the body to be massaged without a large massaging force being required.

Advantageously, the applicator element partially projects from the holding device, for example.

Also advantageously, by way of example, the holding device for the applicator element comprises a sealing neck against which the applicator element is able selectively to bear so as to close off said neck.

Preferably, the holding device is made at least partially of a deformable material.

According to one example of an embodiment, the cap has a bearing zone in which the cap bears against the applicator member, with the bearing zone having an indentation such that the force exerted on the applicator element is less in the closed position than in a position of maximum applied force. This makes it possible to keep the cap in the closed position while making use of the necessary resilience of the seal or sealing means.

According to an example, the applicator member comprises an applicator element made of a compressible material such as a foam.

Also according to an example, the device comprises a plurality of applicator members having approximately parallel pressing directions.

According to a further example, the device comprises at least two applicator members, spaced apart from one another and each in communication with a respective outlet orifice, and with the cap able to engage with the at least two applicator members so as to close off the outlet orifices.

According to a variant or alternate example (or alternate feature), the cap comprises a peripheral skirt with an elongate cross section.

According to a variant or alternate example, the container has a shoulder, and the guide or guide means is configured such that a free edge of the cap is able to come into abutment with the shoulder of the container.

According to a variant or alternate example, the cap has a peripheral skirt offset laterally with respect to a peripheral skirt of the container when the cap is in a position in which guidance starts, and aligned with the peripheral skirt of the container when the cap is in a covering position.

Preferably, the device comprises a seal or sealing means able to move a closing-off element in the closing-off direction of the orifice.

Advantageously, by way of example, the lock or locking means comprises a fixed bead and a protrusion able to move resiliently in a direction perpendicular to the final section of the closure path and to the general direction of the orifice. This makes it possible to lock the cap without releasing the pressing force on the closing-off element. This makes it possible to decrease the force for closing the cap in order to obtain the same level of closing-off sealing of the orifice. The locking bead may be provided in the track. The protrusion may be provided on the cap.

Advantageously, by way of example, the guide means comprises a plurality of pairs of guide elements, each having a cap-guiding element engaging with a guide element which is fixed relative to the container. In particular, the device comprises at least three pairs of guide elements. This allows the closure path to be virtually identical from one bottle-closure operation to the next. The guide means may be formed directly on the container or on an element secured to the container. The applicator holder may be formed directly by the container or by a component attached to the container.

Advantageously, according to an example, each of the guide tracks has a terminal position corresponding to the closed position of the cap and a final section of track corresponding to the final section of the closure path, the different final sections of track are located on the same side as the corresponding terminal positions.

According to another embodiment, each applicator member comprises an applicator element designed to be supplied with cosmetic product via an orifice.

According to one embodiment, by way of example, at least one applicator member comprises a floating applicator element, with the applicator member comprising a holding device able to hold the corresponding applicator element in a holding area, and with the applicator element partially projecting from the holding device. This allows the projecting part of the applicator element to be applied to a part of the user's body.

Advantageously, by way of example, the holding device corresponding to the floating applicator element has a sealing neck constituting an orifice of the container, with the floating applicator element being an element for closing off the neck.

According to another example of an embodiment, at least one applicator member comprises a pressed-in applicator element, with the cap comprising a bearing zone corresponding to the assembly and being able, in the closed position, to press the applicator element in against one or more orifices of the container in a pressing direction. In other words, the force exerted by the bearing zone of the cap contributes to the closing off of the orifice or orifices.

Advantageously, according to an example, the holding device comprises a part made of deformable material such that the neck can be moved or deformed resiliently in the pressing direction. This allows the pressing force to be maintained when the bottle is closed and to absorb the dimensional variations that result from the massage device being industrially manufactured.

Advantageously, by way of example, the cap guide or guide means comprises two pairs of complementary guide elements corresponding to the applicator member having a pressed-in applicator element. When the cap is in the closed position, the two force-applying points of the two pairs of complementary guide elements and the resulting bearing point between the bearing zone and the pressed-in applicator element together define a locking plane parallel to the closing-off direction of the sealing neck. This allows the manufacturing tolerances relating to the closure of an applicator member to be independent of the manufacturing tolerances relating to the closure of another applicator member of the same massage device. This provides great design flexibility for a range of massage devices having different types of applicator members.

According to a variant or alternate example, at least one pressed-in applicator element comprises a part made of compressible foam. When the foam is not compressed, the cosmetic or care product can migrate through the pores of the foam by capillary action. When part of the foam is compressed against an orifice in the bottle, the pores are closed or greatly reduced in volume and no longer enable this migration. This closes off the orifice, preferably in a sealed manner.

Advantageously, by way of example, the device comprises at least two applicator members having identical applicator elements.

By way of example, the two applicators can roll on a user's skin to provide a particularly effective massage by forcing a fold of skin to form between the applicators. The dermis is thus folded on itself. This promotes internal migration and intracellular exchange without violent compression being exerted in the process and bruising the user. This massage effectiveness is obtained, for example, with spherical applicator elements having a diameter of between 30 and 50 mm, with the distance between the applicator tops being between 1.2 and 2 times the diameter of the applicator.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

Figure 1:
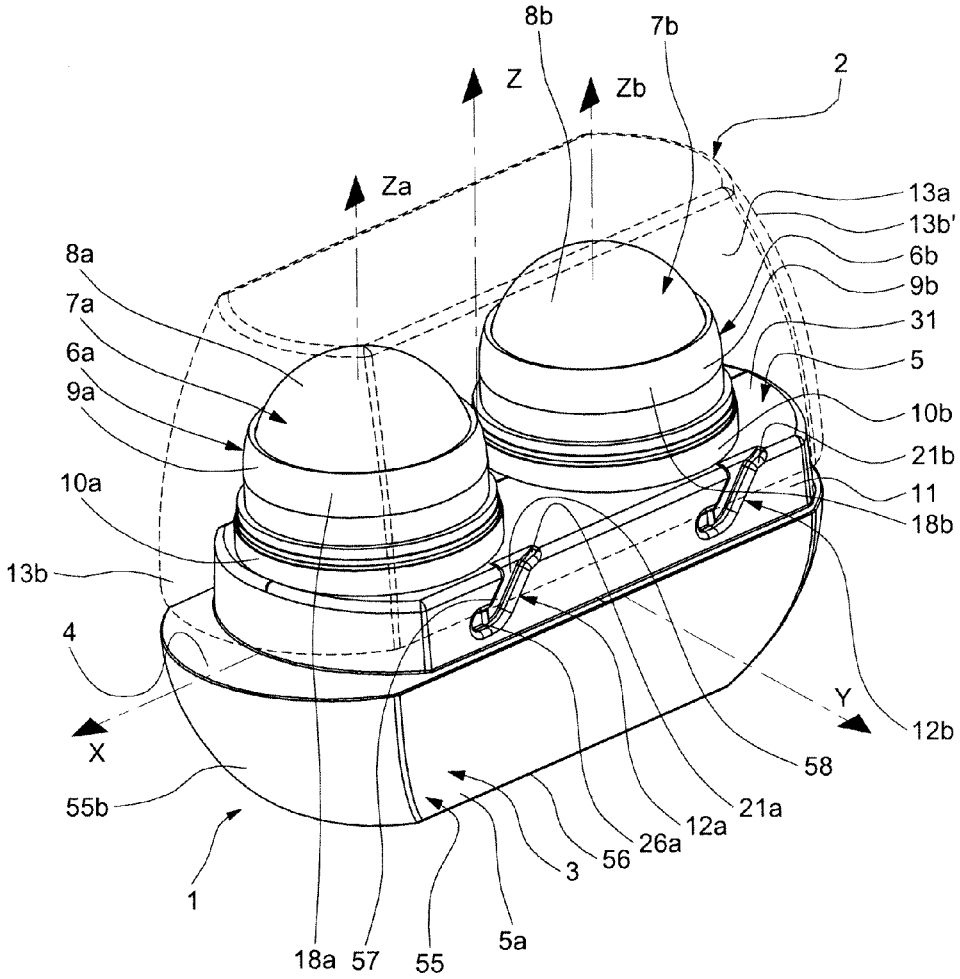
FIG. 1 is a perspective view of a first example of an embodiment of a massage device, shown without its cap.

Referring now to the drawings, like reference numerals are utilized to designate identical or corresponding parts throughout the several views.

As illustrated in the example of FIG. 1, the packaging and application device comprises a main part 1 and a cap 2 illustrated in dotted lines. The main part 1 has a generally elongate form along an axis X and a width along an axis Y. The main part 1 has a base part 3 having a horizontal rim or shoulder 4 extending in the plane (X, Y) around the perimeter of the base part 3 about a pedestal or seat 5 rising above the plane (X, Y).

The main part 1 comprises a container 17 (FIG. 3) intended to contain a cosmetic and/or care product and at least one applicator member 6*a*, 6*b*. The container 17 comprises a peripheral skirt 55 closed off at one end by an end wall 56 and provided at the opposite end with a dispensing neck. This neck bears the horizontal rim on which the pedestal 5 stands.

In this example, the pedestal 5 has a platform 31 from which two applicator members 6*a*, 6*b* project.

In this example, the applicator members 6*a*, 6*b* comprise an applicator element 7*a*, 7*b* held in each case in a holding device 18*a*, 18*b*. Such a holding device 18*a*, 18*b* thus forms an applicator holder.

As will be further explained in the following part of the description, the holding device may be mounted fixedly on the container 17, in particular on its dispensing neck, or be formed in one piece with the container. The holding device, more generally the container, defines an outlet orifice for supplying the applicator member with product.

In the embodiment illustrated, the device has two applicator members 6*a*, 6*b*. Of course, it is possible as a variant to provide a single member or more than two members. In the case of a plurality of applicator members, preferably the applicator members are aligned in order to form one or more parallel rows. Of course, the size of the cap 2 is modified as a result.

The holding devices 18*a*, 18*b* may comprise a shaft open at its two ends and rising vertically from the pedestal 5. A median transverse vertical plane (Y, Z) extends symmetrically relative to the base part 3 in the illustrated example. The pedestal 5 is offset towards the rear of the main part 1 such that the horizontal rim 4 is wider at the front than at the rear. In the illustrated example, the holding devices 18*a*, 18*b* rise symmetrically relative to the median transverse plane (Y, Z) and have identical axisymmetrical forms respectively about a vertical axis Za and a vertical axis Zb located in the longitudinal vertical plane (X, Z). Each of the holding devices 18*a*, 18*b* houses a spherical applicator element 7*a*, 7*b* of which the parts 8*a*, 8*b* smaller than a hemisphere project from an annular holding collar 9*a*, 9*b*. The holding collars 9*a*, 9*b* are fixed on a circular skirt 10*a*, 10*b* projecting vertically from the platform 31 of the pedestal 5 about the axes Za, Zb.

In this example, a single cap 2 covers a plurality of applicator members. However, each applicator member could be enclosed by its own individually movable cap. Such a cap may be attached to the main part 1 between a position covering the applicator member and a removed position.

Figure 3:
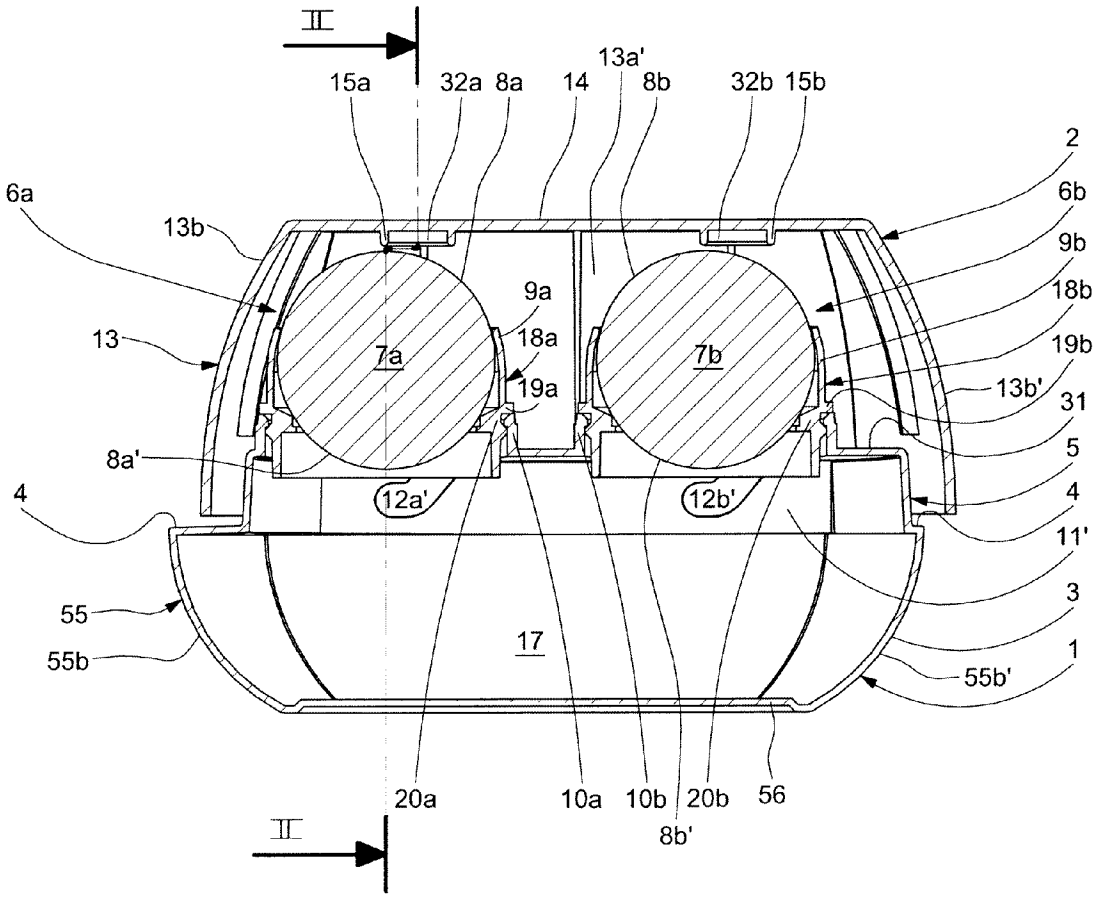
FIG. 3 is a longitudinal section through the massage device from FIGS. 1 and 2, on the plane marked III-III in FIG. 2, with the cap being in the process of being closed.

The pedestal 5 comprises a left-hand vertical side flank 11 shown in FIG. 1 and an opposite right-hand vertical side flank 11' shown in FIG. 3, each containing female grooves 12*a* and 12*a*' provided along the axis X level with the applicator member 6*a*. Female grooves 12*b* and 12*b*' are provided along the axis X level with the applicator member 6*b*. Such grooves 12*b*, 12*b*' may thus run on either side of the applicator members 6*a*, 6*b* starting from the platform 31. Each of the four female grooves 12*a*, 12*a*', 12*b*, 12*b*' has an identical profile. The grooves 12*a*, 12*b* are symmetrical to the grooves 12*a*' and 12*b*' in relation to the median longitudinal vertical plane (X, Z). Each groove has two pairs of opposite side flanks or side walls 57 optionally parallel to one another and linked by a web or inner wall 58.

In all of FIGS. 1 to 7, elements having the same reference numerals are similar and have the same function.

Figure 2:
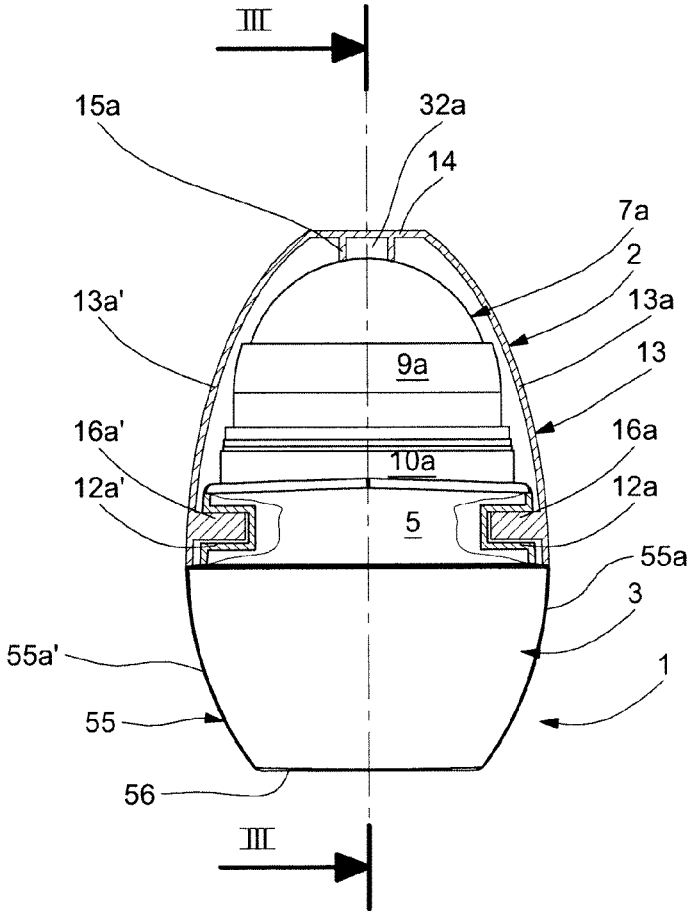
FIG. 2 is a side view of the massage device from FIG. 1, covered with a cap shown in the closed position and in cross section on the plane marked II-II in FIG. 3.

In FIG. 2, elements which are not hatched are a front view of the main part. Hatched elements are a section through the cap 2 and the side flanks 11 and 11' in the transverse vertical plane (Y, Za). In the illustrated example, the main part 1 enclosed by the cap 2 gives the massage device an external form with a vertical egg-shaped cross section, the ends of which are flattened off horizontally. The broad part of the egg shape corresponds to the container 17 and the tapered part is occupied by the applicator elements 7*a* and 7*b*. The cap 2 has the overall form of a hollow shell having a rounded peripheral skirt 13 and a top area 14. The peripheral skirt 13 comprises side flanks 13*a*, 13*a*', a front flank 13*b* and a rear flank 13*b*'. The whole of the cap 2 is able to receive and cover the applicator members 6*a* and 6*b* and also the pedestal 5. The top 14 has a flat external form and has on its internal surface tubular protrusions 15*a* and 15*b* concentric with the axes Za, Zb respectively when the cap 2 is in the closed position. Each of the tubular protrusions 15*a*, 15*b* has a central recess 32*a*, 32*b*. The part of the side flanks 13*a* and 13*a*' facing the female grooves 12*a* and 12*a*' has lateral protrusions 16*a* and 16*a*' extending horizontally in from the cap 2 and respectively penetrating the female grooves 12*a* and 12*a*'. Similarly, the part of the side flanks 13*a* and 13*a*' facing the grooves 12*b* and 12*b*' has lateral protrusions (not shown) extending horizontally so as to engage with the grooves. The pedestal 5 has, around the female grooves 12*a*, 12*a*', 12*b*, 12*b*', a shell having a substantially constant thickness such that the female grooves extend into the pedestal 5. The grooves 12*a*, 12*a*', 12*b*, 12*b*' each have a flared opening or insertion area leading down from the horizontal platform 31 of the pedestal 5. In the figures, only the insertion areas 21 *a* and 21*b* of the grooves 12*a* and 12*b* are visible.

In a variant or alternate example, the guide or guide means may only have a single groove associated with one or more protrusions.

As illustrated in FIG. 3, the base part 3, the pedestal 5 and the circular skirts 10*a* and 10*b* form a one-piece shell of constant thickness defining a single internal volume serving as a container 17 and intended to contain the cosmetic or care product. In this example, the holding devices 18*a*, 18*b* are attached to the main part 1. Therefore, such holding devices 18*a*, 18*b* may form inserts. The holding devices 18*a*, 18*b* may be snap-fastened into the circular skirts 10*a* and 10*b*. Alternatively, these inserts could be tightly fitted, screwed or else ultrasonically welded onto the circular skirts.

Each of the holding devices 18*a*, 18*b* comprises the holding collar 9*a*, 9*b*, a bearing protrusion 19*a*, 19*b* extending radially and resting on the circular skirts 10*a* and 10*b*, and an annular sealing neck 20*a*, 20*b*. This neck may define the outlet orifice for the product in the container. Such a neck may form a sealing lip extending radially into the holding device 18*a*, 18*b* and able to engage with the applicator member. The diameters of the holding collars 9*a*, 9*b* and of the sealing necks 20*a*, 20*b* are less than the diameters of the spherical applicator elements 7*a*, 7*b*. The holding devices 18*a* and 18*b* may be made of a flexible material, for instance of an elastomer such as SEBS, EPDM or polyurethane, for example, or of a thermoplastic such as low density or high density polyethylene or polypropylene, for example.

The spherical applicator elements 7*a*, 7*b* float in their respective holding devices 18*a*, 18*b*. Such applicator elements 7*a*, 7*b* may take up an extreme high position when making contact with a circular ridge of the holding collars 9*a*, 9*b*. The contact with the ridge may be contained or limited to three points of contact. When the spherical applicators 7*a*, 7*b* are in the low position, a circular ridge of contact with the sealing neck 20*a*, 20*b* seals the container 17 with respect to the exterior of the main part 1. Between the extreme high position and the low position, the applicator elements 7*a*, 7*b* are free to move in a floating zone.

In order to massage himself or herself, a user may, after removing the cap 2, take the main part 1 by holding the base part 3 in the palm of one of his/her hands and turning the applicator members 6*a*, 6*b* downwards. In this way, the cosmetic or care product in the container 17 runs naturally towards the sealing necks 20*a* and 20*b* under the force of gravity and moistens the part of the spherical applicator 7*a*, 7*b* projecting into the container 17. By applying the parts 8*a*, 8*b* projecting outwards against a part of the body, a tangential frictional force is applied to the spherical applicator elements 7*a*, 7*b* and causes them to rotate such that the previously moistened part located inside the container 17 moves to the outside and is applied to the part of the body. The amount of cosmetic or care product conveyed in this way from inside the container 17 to the part of the body is limited and controlled by the clearance between the applicator elements 7*a*, 7*b* and the corresponding sealing necks 20*a*, 20*b*.

Figure 4:
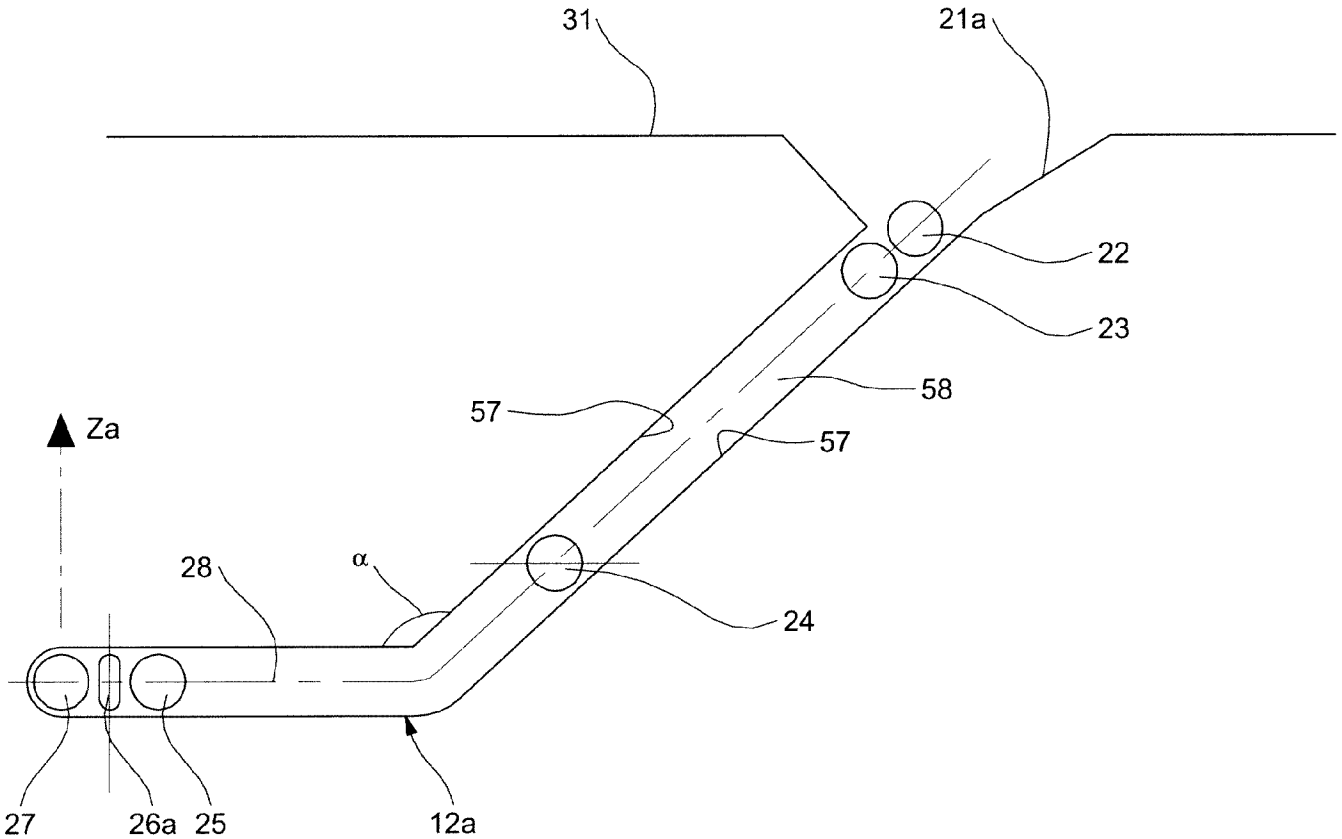
FIG. 4 is an illustration of an embodiment of a guide and locking means of the bottle.

With the aid of FIGS. 3 and 4, the sequence of closing the cap 2 on the main part I will now be described. The user takes the base part 3 of the main part 1 in the palm of one hand and the cap 2 in the palm of the other hand. The rearward offset of the pedestal 5 serves as a visual guide to the user so that, when the latter tries to cover the pedestal 5 with the cap 2, the lateral protrusions of the flanks 13*a* and 13*a*' are each naturally in the open areas of each of the female grooves 12*a*, 12*a*', 12*b*, 12*b*'. These opening areas are funnel-shaped so that by simply pushing the two hands together, the lateral protrusions of the flanks 13*a* and 13*a*' are guided into a position at the bottom of the corresponding open area. In FIG. 4, various positions 22 to 27 of the lateral protrusion 16*a* inside the associated groove 12*a* during the closure of the cap on the main part 1 are shown. As will be realized, the other lateral protrusions provided on the flanks 13*a* and 13*a*' of the cap 2 simultaneously occupy analogous positions in relation to the associated grooves 12*b*, 12*a*' and 12*b*'.

When the cap 2 and the main part 1 are being brought together, the lateral protrusion 16*a* is in position 22. By performing an overall shearing movement of his/her hands, the user allows the lateral protrusions to occupy a position in which guidance starts at the entrance of the female grooves 12*a*, 12*a*', 12*b*, 12*b*'. This position corresponds to position 23 in FIG. 4. In this position 23 in which guidance starts, the side flanks 13*a* and 13*a*' of the cap 2 are aligned with the side parts 55*a*, 55*a*' (FIG. 2) of the peripheral skirt 55 of the container 17. However, the front flank 13*b* and the rear flank 13*b*' of the cap 2 are offset laterally with respect to the front part 55*b* and the rear part 55*b*' (FIG. 3) of the peripheral skirt 55 of the base part 3.

By continuing the shearing movement and the bringing together of the two hands, with one hand holding the cap 2 and the other the main part 1, the cap 2 follows a closure path and passes through a position where the sealing necks 20*a*, 20*b* start to be closed off, corresponding to the moment when the tubular protrusions 15*a*, 15*b* start to bear against the spherical applicator elements 7*a*, 7*b* and press the applicator elements 7*a*, 7*b* into a low position against the sealing necks 20*a*, 20*b*. The product outlet orifices are then closed off by said product applicator members. This position where the sealing necks 20*a*, 20*b* start to be closed off corresponds to position 24 in FIG. 4.

By continuing the closure path as far as a position 25 of maximum applied force (FIG. 4), the tubular protrusions 15*a*, 15*b* slide laterally on the projecting part 8*a*, 8*b* of the applicator elements 7*a*, 7*b* and increase the sealing pressure on the sealing necks 20*a*, 20*b* of the holding devices 18*a*, 18*b*. By virtue of the fact that the bearing protrusions 19*a*, 19*b* of the holding devices 18*a*, 18*b* have a greater diameter than the ridge of contact between the sealing necks 20*a*, 20*b* and the applicator elements 7*a*, 7*b*, the sealing necks flex resiliently through the entire axial distance between the position 24 where closing off begins and the position 25 of maximum applied force.

When the cap 2 reaches the covering position, the front flank 13*b* and the rear flank 13*b*' of the cap 2 are aligned with the front part 55*b* and the rear part 55*b*' of the peripheral skirt 55 of the container 17. Overall, in the position 23 in which guidance starts, the peripheral skirt 13 of the cap 2 is offset laterally with respect to the peripheral skirt 55 of the container 17. In the covering position, the peripheral skirt 13 of the cap 2 is aligned with the peripheral skirt 55.

The translation path of the cap 2 comprises a final horizontal linear or rectilinear section extending along the axis X transverse to the axes Za and Zb, and an angled linear or rectilinear section at an angle $\alpha$. This angle $\alpha$ may, for example, be between 110° and 160° and even more preferably between 130° and 145°. The angled section may be configured to convey the tubular protrusions 15*a*, 15*b* of the cap respectively to the level of or facing the upper end of the applicator member 6*a*, 6*b* and the horizontal section may be adjusted to convey these protrusions to bear against the applicator member so as to close off the corresponding product outlet. The sliding of the cap is thus carried out in translation directions different from the axes Za and Zb.

Figure 5:
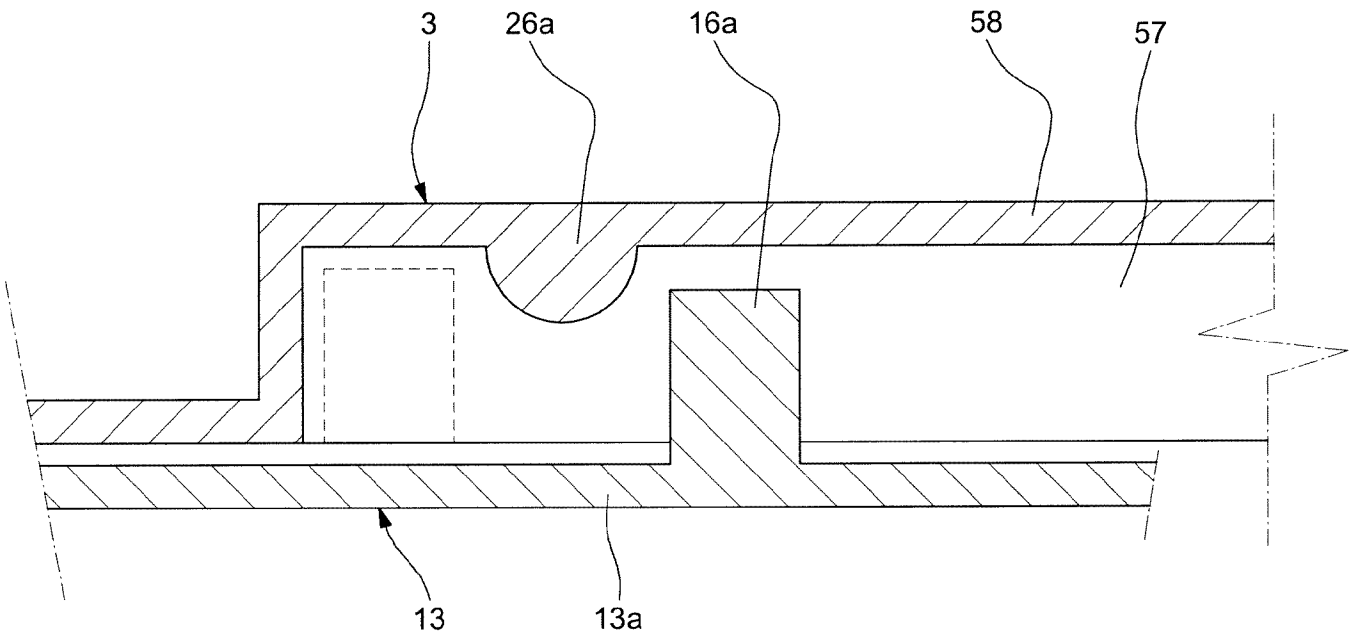
FIG. 5 is an illustration of another embodiment of a guide and locking means of the bottle.

As illustrated in FIGS. 4 and 5, the female groove 12*a* has an inner wall or web 58 and two parallel side flanks or side walls 57. Alternatively, the groove 12*a* could have non-parallel flanks or even only one upper flank 57 on which the protrusion 16*a* slides. The abovementioned angle $\alpha$ corresponds to the angle of the flank 57 on which the protrusion 16*a* slides. As shown in the figures, the insertion area 21*a* may comprise side flanks converging towards one another in order to facilitate the positioning and guiding of the protrusion 16*a* in the groove.

The inner wall 58 of the grooves has a fixed bead 26*a* designed so that by following the closure path, the lateral protrusion 16*a* slides over said bead, deforming the side flank 13*a* of the cap 2 in the lateral direction Y, i.e. in a direction perpendicular both to the general directions Za and Zb of the orifice and to the final section 28 of the closure path when proceeding from the position 24 where closing off begins to the locked position 27. Of course, the grooves 12*a*', 12*b* and 12*b*' are identical to the groove 12*a* and also have locking beads.

With the aid of FIG. 6 another embodiment of both the guide means and the locking means of the massage device will be described. The closure path also has the position 23 in which guidance starts, the position 24 in which closing off begins, the position 25 of maximum applied force and the locked position 27. However, the final section of the closure path has a different form that does not include a section perpendicular to the general direction of the orifice. The final section of the closure path from the position 24 in which closing off begins to the locked position 27 may have any angle of slope with respect to the general direction Za of the orifice, however the user also closes the cap by performing an overall axial shearing movement of his/her hands.

Figure 6:
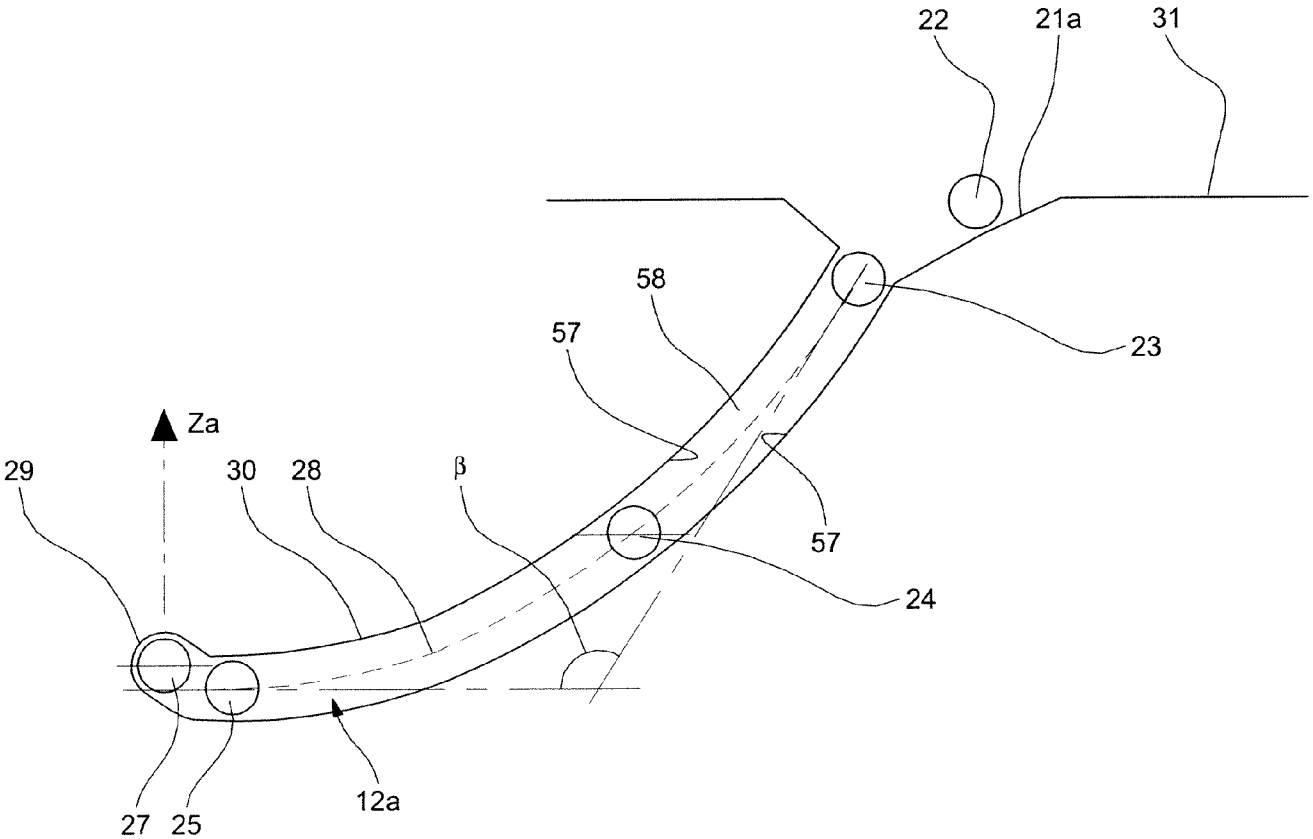
FIG. 6 is a partial section through a lock or locking means from FIG. 5.

The female groove 12*a* illustrated in FIG. 6 has a terminal section 29 such that the locked position 27 of the protrusion 16*a* is higher than the position of said protrusion 16*a* in the position 25 of maximum applied force, while being much lower than the position 24 in which closing off begins. The resilience of the sealing necks 20*a* and 20*b* enables the closing-off sealing to be maintained. Such a groove 12*a* also constitutes a lock or locking means because in order to open the cap 2 the user must exert a shear force opposite to that for closing in order to pass back through the position 25 of maximum applied force.

The translation path of the cap 2 with respect to the container is in this case along a curvilinear path having two different curvatures the axes of which are transverse to the axes Za and Zb, and offset laterally with respect to the axes. The path has two different directions which are tangent to the path of the protrusion 16*a* at the position 25 of maximum applied force and tangent to the path at the position 23 in which guidance starts. These two directions form an angle β between themselves. The translation path may be associated with these two tangents. In the case of a groove 12*a*, 12*a*', 12*b*, 12*b*' having parallel flanks 57, the angle β may be measured using the planes tangent to the flanks of the groove. Generally, the angle β between the two directions of the translation path is measured using the flank 57 of the guide means on which the protrusion 16*a* of the cap 2 slides, or vice versa. Next, the angle between the planes tangent to said flank 57 at the point of maximum applied force and at the start of guiding is measured. This angle β may have values similar to the angle α.

In another variant of the locking mechanism, the final section of the track 30 is horizontal and has neither a bead nor a lifted terminal position 29. By virtue of the central recess 32*a*, 32*b* in the tubular protrusion 15*a*, 15*b*, the force with which the applicator element 7*a* is pressed in against the sealing neck 20*a* passes through a maximum when the tubular protrusion 15*a* bears against the top of the applicator element 7*a*, i.e. before reaching the locked position 27.

Thus, by way of example, one of the grooves 12*a*, 12*a*', 12*b*, or 12*b*' can have either a bead 26*a* or a final raised position 29 for locking of the cap 2 to be ensured. Also by way of example, even in the absence of these locking features, the lateral protrusions of the cap 2 can exert a frictional force on the corresponding female grooves as a result of the pressing force maintained in order to ensure the sealing of the applicator element 7*a* or 7*b* against the sealing neck 20*a* or 20*b*.

Figure 7:
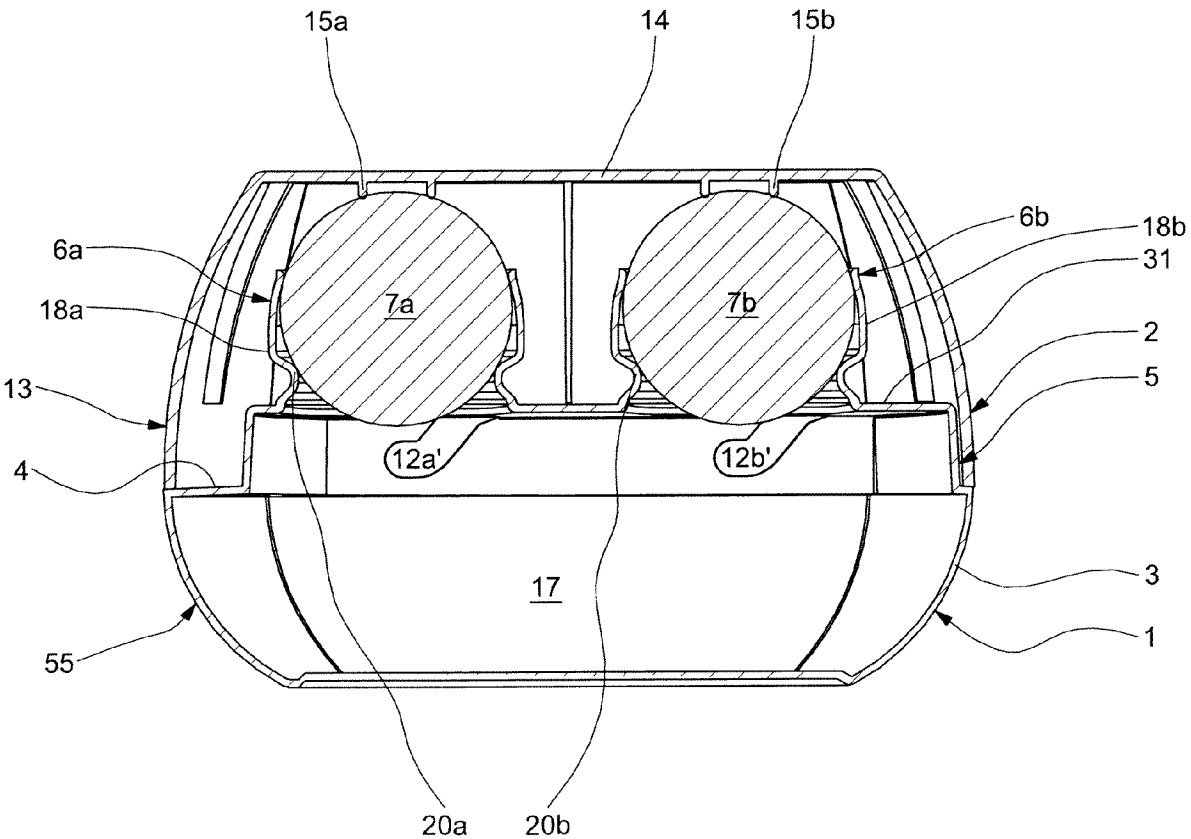
FIG. 7 is a longitudinal section through a second embodiment of a massage device, the cap being shown in the closed position.

In the embodiment illustrated in FIG. 7, in which identical elements bear the same reference numerals, the holding devices 18*a*, 18*b* and the main part 1 are made in one piece. The general directions Za and Zb of the two orifices are unchanged and all the variants previously envisaged, such as guide tracks, can also be included in this embodiment. The axial distance in the main directions Za and Zb of the orifice separating the position in which closing off begins from the position of maximum applied force is, however, reduced and corresponds to the resilience of the shell of the cap 2 or of the pedestal part 3.

Figure 8:
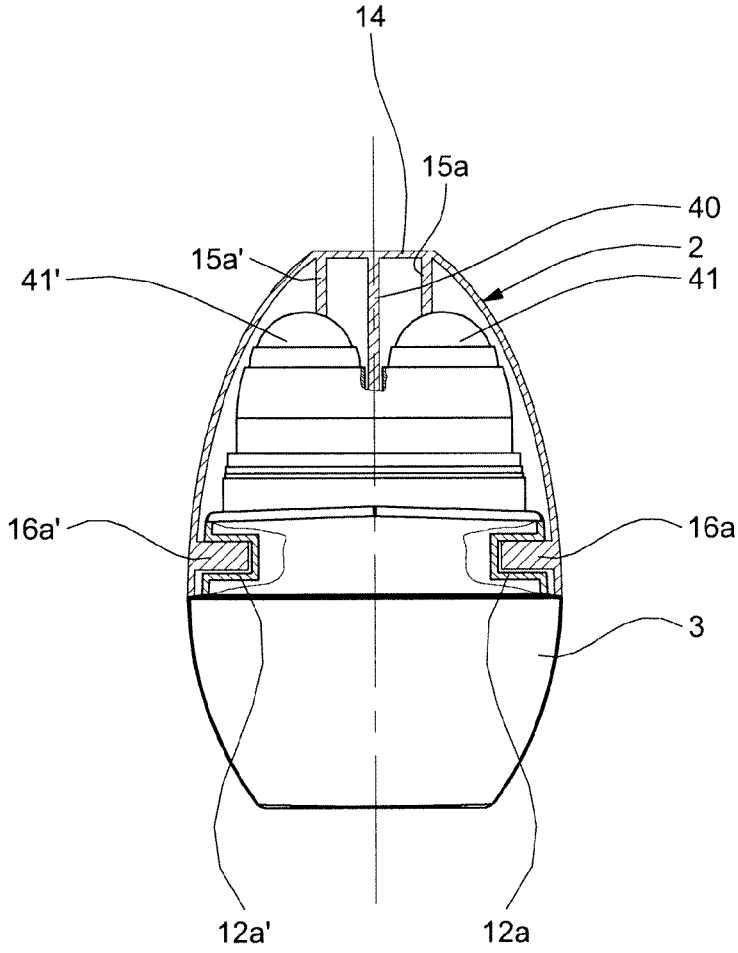
FIG. 8 is an illustration of a third embodiment of a massage device.

In the embodiment illustrated in FIG. 8, in which identical elements bear the same reference numerals, the top 14 of the cap 2 has two bearing zones 15*a*, 15*a*' on two applicator members 41, 41'. The top 14 furthermore has a central rib 40 for closing off an outlet orifice in the form of a supply duct (not shown) connecting the container 17 to a plurality of applicator members 41, 41'. The fact that the cap 2 is locked to the main part 1 by way of a shearing movement of the user's hands, i.e. in an overall direction transverse to the general directions of the applicator orifices 41, makes it possible to provide an aligned row of applicators 41 so that the device takes up less space.

Figure 9:
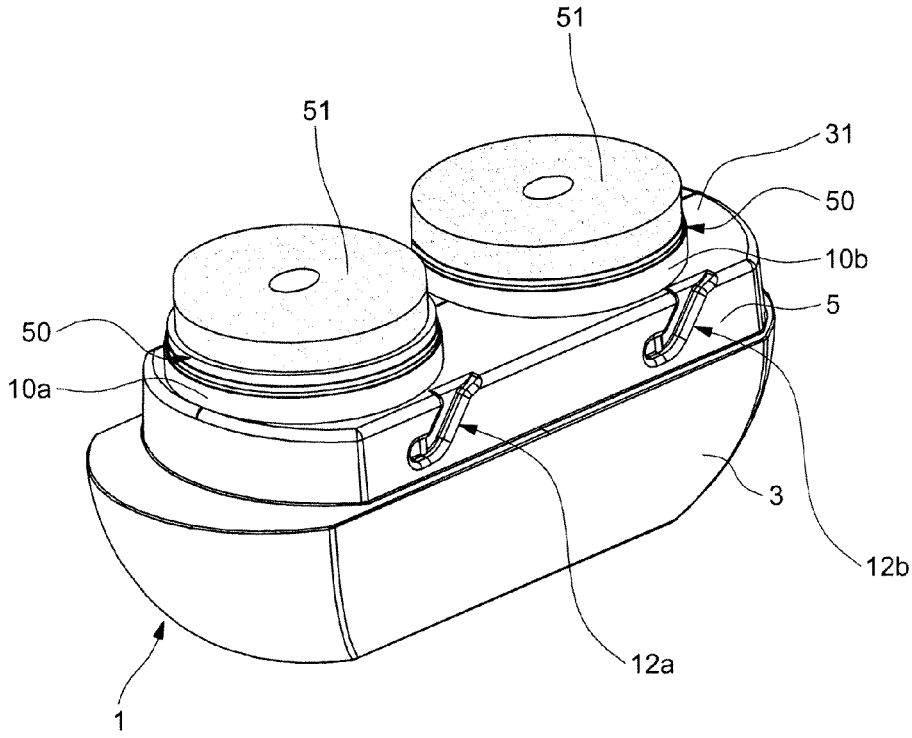
FIG. 9 is an illustration of a fourth embodiment of a massage device, shown without a cap.
Figure 10:
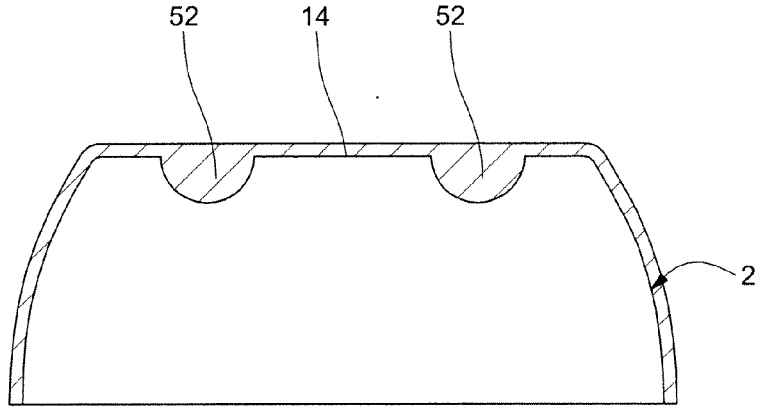
FIG. 10 is an illustration of an example of a cap suitable for the embodiment seen in FIG. 9.

In the embodiment illustrated in FIGS. 9 and 10, in which identical elements bear the same reference numerals, the applicator members 50 comprise a non-moving (or non-rotating) foam 51 fixed above orifices (not shown). The top 14 of the cap comprises projections 52 which slide over the foam 51 and finish their closing movement by compressing the foam 51 over the outlet orifices, such that the latter are closed off by the compressed foam 51.

Obviously, numerous modifications and variations of the present invention are possible in light of the above teachings. It is therefore to be understood that within the scope of the appended claims, the invention may be practiced otherwise than as specifically described therein.

What is claimed as new and desired to be secured by Letters Patent of the United States is:

1. A device for packaging and applying a cosmetic or care product, comprising:

a container, intended to contain the product and having at least one product outlet orifice;

at least one applicator member connected to said container so as to be in communication with said outlet orifice;

a cap including a top and a peripheral skirt, the cap being removably mounted on said container such that said cap is movable between a closed position covering the applicator member and a removed position, wherein said cap abuts against said applicator member in order to close off said outlet orifice in the closed position by said applicator member; and guide means for guiding the cap in relation to the container, wherein the guide means are configured such that the cap is guided in relation to the container along a translation path without rotation, said translation path extending in at least two different directions and including a closure path, a final section of the closure path extending at least partially transversely to a pressing direction associated with closing of the orifice, wherein the top and the peripheral skirt of the cap slide transversely to the pressing direction in the final section of the closure path.

2. A device according to claim 1, wherein the guide means are configured such that the cap is guided in relation to the container only along the translation path.

3. A device according to claim 1, wherein the cap has at least one substantially rigid part, and wherein the guide means for guiding the cap are arranged such that, in a final section of a closure path, points of the rigid part of the cap move parallel to one another.

4. A device according to claim 1, comprising a locking means holding the cap in a closed position.

5. A device according to claim 4, wherein the guide means guides the cap along a closure path, and wherein the locking means comprises at least one fixed bead able to engage with a protrusion that can move resiliently in a direction perpendicular to a final section of the closure path.

6. A device according to claim 1, wherein the guide means comprises at least one protrusion provided on the cap and which engages with a corresponding guide track formed on the container or vice versa.

7. A device according to claim 6, wherein said guide track has a groove comprising two opposite side walls connected by a web.

8. A device according to claim 7, wherein said guide track comprises an insertion area for said protrusion, and wherein in said insertion area said side walls converge towards one another.

9. A device according to claim 6, wherein said guide track has a first section for conveying a part of the cap to a level of said applicator member and a second section for conveying said part into abutment against said applicator member so as to close off said outlet orifice.

10. A device according to claim 6, wherein said guide track has a first section and a second section that define between themselves an angle of between 100° and 160°.

11. A device according to claim 6, wherein the guide track extends along a vertical flank of the container.

12. A device according to claim 1, wherein said guide means extend on either side of said applicator member.

13. A device according to claim 12, wherein the container includes opposite vertical flanks, and wherein the guide means comprise at least two guide tracks, each formed in one of the opposite vertical flanks of the container, and wherein said opposite vertical flanks extend on either side of the applicator member and are approximately parallel to one another.

14. A device according to claim 1, wherein said applicator member comprises at least one surface that can be supplied with a cosmetic product from the container.

15. A device according to claim 1, wherein said applicator member comprises an applicator element having the form of a sphere, a cylinder, a barrel or an ellipsoid.

16. A device according to claim 1, wherein said applicator member comprises an applicator element free to move in rotation and/or translation inside a holding device.

17. A device according to claim 16, wherein the applicator element partially projects from said holding device.

18. A device according to claim 17, wherein the holding device for the applicator element comprises a sealing neck against which said applicator element is able selectively to bear so as to close off said sealing neck.

19. A device according to claim 16, wherein said holding device is made at least partially of a deformable material.

20. A device according to claim 1, wherein the cap has a bearing zone in which the cap bears against said applicator member, said bearing zone having an indentation such that the force exerted on the applicator element is less in the closed position than in a position of maximum applied force, and wherein the cap passes through said position of maximum applied force before reaching the closed position.

21. A device according to claim 1, wherein said applicator member comprises an applicator element made of a compressible material.

22. A device according to claim 21, wherein said compressible material includes a foam.

23. A device according to claim 1, comprising a plurality of applicator members having approximately parallel pressing directions.

24. A device according to claim 1, comprising at least two applicator members, spaced apart from one another and each in communication with a respective outlet orifice, wherein the cap engages with said at least two applicator members so as to close off said outlet orifices.

25. A device according to claim 1, wherein the cap comprises a peripheral skirt with an elongate cross section.

26. A device according to claim 1, wherein the container has a shoulder, and wherein the guide means are configured such that a free edge of the cap comes into abutment with said shoulder of the container.

27. A device according to claim 1, wherein the cap has a peripheral skirt offset laterally with respect to a peripheral skirt of the container when the cap is in a position in which guidance starts, and wherein the peripheral skirt of the cap is aligned with said peripheral skirt of the container when the cap is in the closed position.

28. A device according claim 1, wherein said guide means includes a guide having an inclined or arcuate portion to control movement of said cap relative to said container as the cap is moved to the closed position, and wherein as said cap moves to the closed position the inclined or arcuate portion causes a bearing zone of the cap to move toward and contact the application member without rotation of said cap.

29. A device according to claim 1, wherein in the closed position, a force between the cap and the applicator member is less than the force at a maximum force position during travel along the guide means.

30. A device for packaging and applying a cosmetic or care product, comprising:

a container, containing the product and having at least one product outlet orifice;

at least one applicator member connected to said container so as to be in communication with said outlet orifice;

a cap including a top and a peripheral skirt, the cap being removably mounted on said container such that said cap is movable between a closed position covering the applicator member and a removed position, and wherein in said closed position said cap abuts against said applicator member in order to close off said outlet orifice by said applicator member; and a guide which guides movement of the cap relative to the container as the cap is moved to the closed position, wherein the guide is configured such that the cap is guided along a translation path without rotation of said cap relative to the container, the translation path extends in at least two different directions and includes a closure path, a final section of the closure path extending at least partially transversely to a pressing direction associated with closing of the orifice, wherein the top and the peripheral skirt of the cap slide transversely to the pressing direction in the final section of the closure path and wherein the guide guides movement of the cap such that as the cap moves to the closed position a bearing portion of the cap applies a force on the applicator member to close the at least one product outlet orifice.

31. A device according to claim 30, wherein movement along the guide causes the cap to progressively exert an increased force against the application member to close the outlet orifice and wherein the cap reaches the closed position after passing a maximum force position during travel along said guide.

32. A device according to claim 31, wherein in the closed position, a force between the cap and the applicator member is less than the force at the maximum force position.

33. The device according to claim 30, wherein the guide is configured such that the cap is guided in relation to the container only along the translation path.

34. The device according to claim 30, wherein the guide includes at least one protrusion provided on the cap that engages with a corresponding guide track formed on the container.

35. The device according to claim 30, wherein the cap has a bearing zone in which the cap bears against the applicator member, said bearing zone having an indentation such that the force exerted on the applicator element is less in the closed position than in a position of maximum applied force, and wherein the cap passes through said position of maximum applied force before reaching the closed position.

36. The device according to claim 30, comprising at least two applicator members, spaced apart from one another and each in communication with a respective outlet orifice, wherein the cap engages with said at least two applicator members so as to close off said outlet orifices.

37. The device according to claim 30, wherein in the closed position, a force between the cap and the applicator member is less than the force at a maximum force position during travel along the guide.

* * * * *